US006354665B1

(12) United States Patent
Ross

(10) Patent No.: US 6,354,665 B1
(45) Date of Patent: Mar. 12, 2002

(54) INFLATABLE INFANT SITTING SUPPORT

(76) Inventor: Elisabeth Helen Ross, 9947 S. Melbourne Cir., Highlands Ranch, CO (US) 80126

( * ) Notice: Subject to any disclaimer, the term of this patent is extended or adjusted under 35 U.S.C. 154(b) by 0 days.

(21) Appl. No.: 09/500,037

(22) Filed: Feb. 8, 2000

Related U.S. Application Data

(60) Provisional application No. 60/118,992, filed on Feb. 8, 1999.

(51) Int. Cl.[7] ..... A47C 23/00

(52) U.S. Cl. ..... 297/452.41; 297/250.1; 297/DIG. 3; 297/487; 5/655; 5/431

(58) Field of Search ..... 297/452.41, 250.1, 297/256.15, 464, 487, DIG. 3; 5/655; 4/572.1, 588, 496, 504

(56) References Cited

U.S. PATENT DOCUMENTS 1,623,259 A * 4/1927 McGregor et al. ..... 297/487 X
2,350,679 A * 6/1944 Hann ..... 297/452.41
3,265,438 A * 8/1966 Regan et al. ..... 297/250.1 X
3,408,107 A * 10/1968 Savage ..... 297/452.41
3,635,528 A * 1/1972 Strom ..... 297/452.41
3,712,674 A * 1/1973 Ando ..... 297/452.41
3,740,095 A * 6/1973 Nail ..... 297/452.41
4,160,299 A * 7/1979 Hilbern ..... 297/452.41 X
4,370,769 A * 2/1983 Herzig et al. ..... 297/452.41 X
4,583,253 A * 4/1986 Hall ..... 297/250.1 X
4,601,667 A * 7/1986 Hull ..... 297/DIG. 3 X
4,627,659 A * 12/1986 Hall ..... 297/DIG. 3 X
4,687,452 A * 8/1987 Hull ..... 297/250.1 X
4,759,588 A * 7/1988 Husnik ..... 297/250.1 X
4,836,605 A * 6/1989 Greenwood et al. ... 297/452.41 X
4,980,937 A * 1/1991 Mason et al. ..... 5/431
5,005,902 A * 4/1991 Farnworth et al. .. 297/452.41 X
5,076,264 A * 12/1991 Lonardo et al. ..... 297/464 X
5,095,567 A * 3/1992 Kenoyer ..... 5/655
5,115,529 A * 5/1992 White ..... 5/655
5,261,134 A * 11/1993 Matthews ..... 5/655
5,335,968 A * 8/1994 Sheridan et al. ... 297/DIG. 3 X
5,490,717 A * 2/1996 Greene ..... 297/452.41
5,516,188 A * 5/1996 Bruhnke et al. .... 297/452.41 X
5,699,569 A * 12/1997 Schwarz-Zohrer . 297/DIG. 3 X
6,012,778 A * 1/2000 Peterson ..... 297/452.41
6,079,067 A * 6/2000 Becker et al. ..... 5/655
6,179,383 B1 * 1/2001 Ochi ..... 297/452.41 X

* cited by examiner

*Primary Examiner*—Jose V. Chen
*Assistant Examiner*—Rodney B. White

(57) ABSTRACT

An inflatable infant sitting support device which can be used from the earliest developmental stage of learning to sit upright by an infant or a younger developmentally delayed child, consisting of four inflatable pieces and one cushioned, non-inflatable piece, which acts as the seat bottom for the device. The primary inflatable piece is "U" or horseshoe shaped and is sealed to the top of the cushioned, non-inflatable piece. There is an elongated, rectangular inflatable piece, acting as a support to keep the device from tapping over to the back, sealed to the bottom of the back of the curved section at the back of the primary inflatable piece. There is a crescent-shaped inflatable piece acting as a head and neck support and sealed to the top of the curved section at the back of the primary piece. The final inflatable piece is a detachable safety bar which can be snapped across the top of the front of the device to stop an infant's fall forward and to give an infant or developmentally delayed child something to grasp and try to maintain balance, while still using and strengthening the muscles needed to sit upright without support. The entire chair is made out of vinyl or vinyl-type plastic material so that the device is easy to wipe clean, as well as easy to deflate and fold into a small package to be stored or packed for travel.

8 Claims, 3 Drawing Sheets

INFLATABLE INFANT SITTING SUPPORT

This Application claims Benefit of provisional Application Ser. No. 60/118,992 filed Feb. 8, 1999.

CROSS-REFERENCE TO RELATED APPLICATIONS

Not Applicable.

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

This invention relates generally to an infant sitting support device and more specifically to an inflatable infant sitting support device with an inflatable and detachable safety bar across the front, that allows an infant or young developmentally delayed child to sit safely and comfortably without frequent adult intervention during the developmental stages when the infant or younger developmentally delayed child does not yet have the full ability of sitting upright without support. Furthermore the inflatable safety bar attached across the front provides a means for an infant or developmentally delayed child who has fallen forward, to return to an upright sitting position alone and maintain balance while sitting, thus allowing the infant or developmentally delayed child to strengthen and learn to use the muscles needed to sit upright without support.

The prior art contains several devices intended to be used as sitting support devices for infants and young children, ranging from pillow like devices to be placed around the middle of the infant that also double as nursing pillows and infant propping devices, to devices designed specifically for the developmental stage when infants are first learning to sit upright.

U.S. Pat. No. 5,261,134 (Matthews) discloses an Infant Support Pillow which is designed to act as a pillow support when feeding an infant in a cradled position, when laying an infant within the confines of the device and as a lower back support for infants learning to sit alone. The device disclosed by Matthews however, is not high enough on the back or sides to prevent an infant from falling over the back or sides and there is nothing across the front to prevent falls forward or for an infant to grasp onto and maintain balance.

U.S. Pat. No. 5,095,567 (Kenoyer) discloses a Baby Back Support which is meant to be attached to the lower back of an infant with the base of the triangular pillow support touching the floor when the infant is sitting and thereby acting as a sitting support. The device disclosed by Kenoyer can help keep an infant from falling over backward however, it does not address the infant falling over to the sides or the front.

U.S. Pat. No. 4,836,605 (Greenwood, et at) discloses an Inflatable Booster Seat which consists of an upper "U" shaped piece attached to a bottom doughnut shaped piece, both of which are inflatable. The device disclosed by this patent however, is intended for use by young children when sitting on a regular adult sized chair and is not intended for use by young infants as a sitting support.

U.S. Pat. No. 5,115,529 (White) discloses a Support for selectively seating and developing balance and motor control in infants. This device is comprised of two freestanding cushion-like pieces which can be combined together to make the sitting support. While the sides are high enough to prevent an infant from falling over them, there is no support in the front to prevent an infant from falling over forward, nor is there anything for the infant to grasp onto and maintain balance.

U.S. Pat. No. 4,980,937 (Mason, et al) discloses an Infant Sitting Support and Head Protection Ring comprised of a circular or oval ring with the back wall raised and intended to hold an infant snugly within the interior of the ring. While the disclosed device does address an infant falling forward, this device would not be suitable for developmentally delayed children as a sitting support device because it is made to the size of an infant and does not allow for an infant or child to have straightened legs.

U.S. Pat. No. 5,005,902 (Famworth et al) discloses a Seat for Baby which is inflatable and horseshoe shaped with a non-inflatable seat bottom and buttresses on the outer sides, however the height of the inflatable horseshoe shaped wall is not the same throughout and tapers at the ends, the non-inflatable seat bottom does not contain a cushioned area and it is not noted in the disclosure that it is made with a rayon-flocked vinyl or other skid proof surface. Furthermore there is not a Head and Neck Support piece and there is no support bar to be placed across the top of the front of the device. Therefore, protection for an infant that falls forward is not addressed and there is nothing for an infant or developmentally delayed child to hold onto for balance.

BRIEF SUMMARY OF THE INVENTION

It is the general object of the present invention to provide an inflatable infant sitting support that is safe, comfortable, effective, economical and convenient. It is also the object of the present invention to provide an inflatable infant sitting support that is useful from an infant's first attempts to sit upright when they still fall forward as well as backward and to the sides, until the infant has grown into a child who would just like a support cushion for sitting comfortably on the floor. Another object of the present invention is to provide an inflatable sitting support that can be used by younger developmentally delayed children in attempts to sit upright. A further object of the present invention is to provide an inflatable infant sitting support that is easy to wipe clean and can be deflated and folded into a small enough parcel that it can easily be stored in small spaces or packed in a suitcase when traveling.

The present invention is comprised of five pieces, four of which are inflatable. The fifth piece being flat with a central padded area to cushion the bottom of the infant or child when seated upon the floor. The primary inflatable piece is shaped like a tubular letter "U" or horseshoe, with the inflated sides and back of the piece all having the same height or diameter throughout, and has an open front to allow for the infant or child to sit inside the "U" or horseshoe with straightened legs. The back of the primary piece is shaped like the curve in the letter "U" or horseshoe and includes two other attached inflatable pieces, one attached at the top of the back of the primary piece and the other attached to the bottom of the back of the primary piece. The inflatable piece attached to the top of the back of the primary piece has an inflated crescent shape and is intended to support the head and neck of an infant or child when sitting in the support device. The inflatable piece attached to the bottom of the back of the primary piece is shaped like an elongated rectangle and is intended to prevent the support device from tipping over backward. The final inflatable piece is the safety bar, which can be attached across the top of the front of the primary inflatable piece and is intended to prevent an infant from falling forward completely to the floor. The safety bar also provides something infants can hold onto for balance and for trying to push themselves back into an upright sitting position without adult intervention. The non-inflatable fifth piece, as above, is a layered piece of vinyl, shaped to enclose the opening at the bottom of the "U" or horseshoe shaped, inflatable primary piece and acts as the seat part of the sitting support device. This fifth piece has a central padded area to cushion the bottom of the infant or child sifting on the floor and it is attached to the bottom of the primary inflatable piece along two continuous lines following the shape of the "U" or horseshoe. One continuous line following along the center of the inflated "U" or horseshoe shape—the center of where the inflated device is touching the floor. The second continuous line also following along the "U" or horseshoe shape, however placed close enough to the area where the infant will sit so as to prevent an infant's head from becoming stuck between the primary inflatable piece and the non-inflatable bottom of the device.

DETAILED DESCRIPTION OF THE INVENTION

Figure 1:
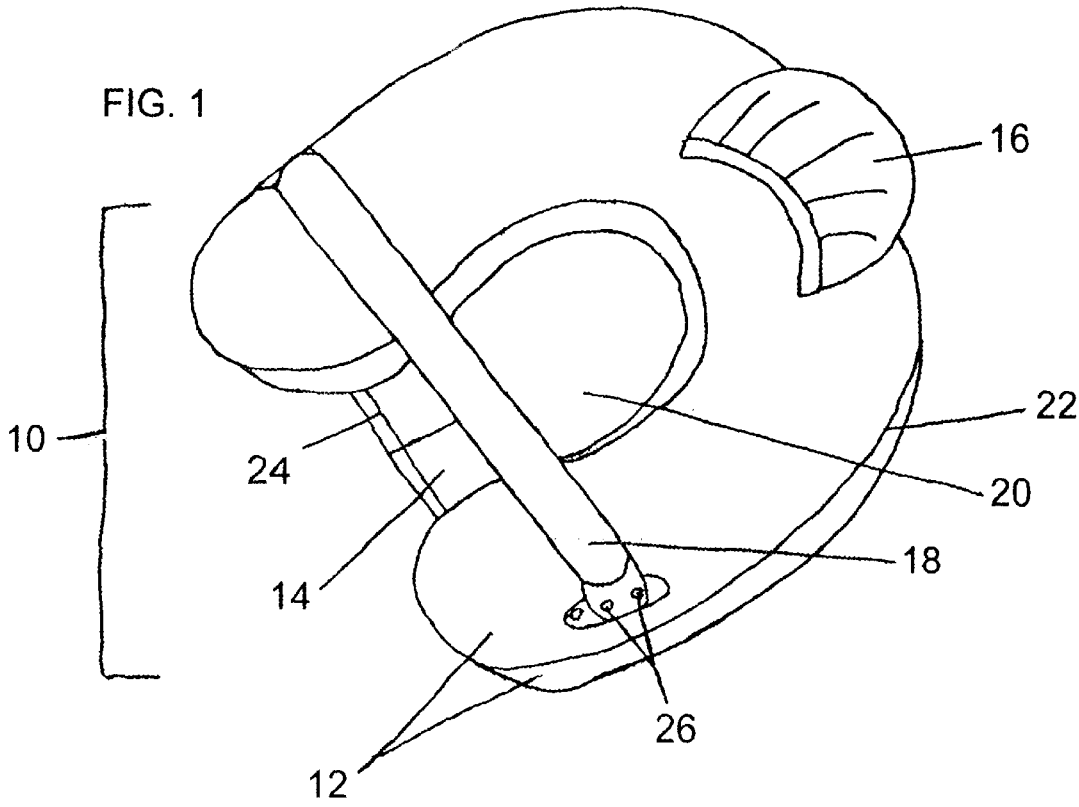
FIG. 1 is a perspective view of the sitting support disclosed in the present invention.
Figure 2:
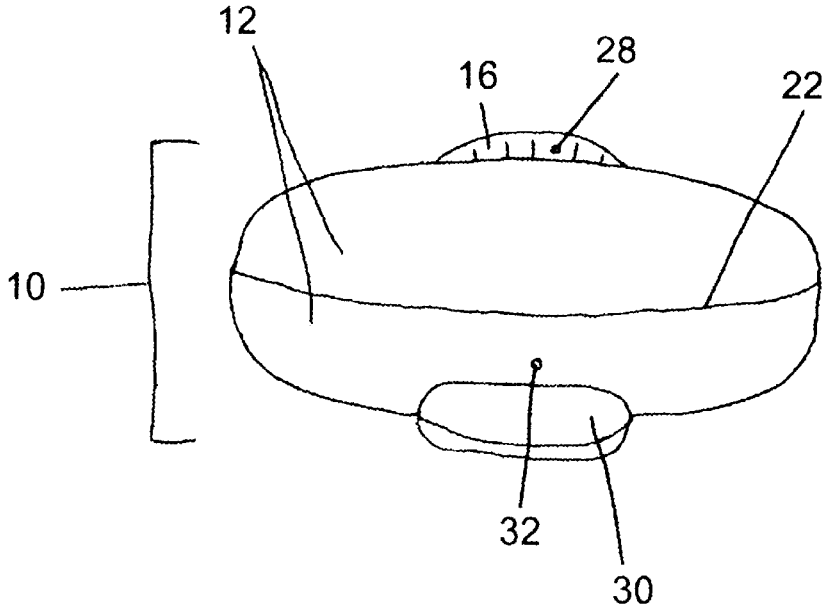
FIG. 2 is a rear view of the sitting support disclosed in the present invention.

As shown in FIG. 1 and FIG. 2, the inflatable infant sitting support device, generally designated 10, is comprised of four inflatable pieces and one non-inflatable piece. The primary inflatable piece 12 is comprised of two pieces of "U" or horseshoe shaped vinyl, that are sealed together along the seams 22 shown and have an air valve 32 placed on the bottom half of the back of the primary inflatable piece 12. The sides of the "U" or horseshoe shaped vinyl used to make the primary inflatable piece have a width of 30 cm, the length of the "U" or horseshoe shape from top to bottom is 77 cm and the width of the entire "U" or horseshoe shape is 60 cm.

The non-inflatable seat base 14 is a flat piece of vinyl that completely encloses the bottom of the opening at the center of the primary inflatable piece 12. The length of the non-inflatable seat base from top to bottom is 50 cm and the width across the bottom is also 50 cm. The circular cushioned section 20 of the non-inflatable seat base 14 is filled with a cushioned material, such as foam rubber. The front seam 24 on the seat base 14 is drawn to show that the front edge of the vinyl comprising the seat base 14 is folded over and sealed along the bottom of the seat base 14.

The second inflatable piece is the head and neck support piece 16 and it is attached to the inner top of the primary inflatable piece 12 so that the crescent shape is curved away from the area intended for the infant or child to sit. The head and neck support piece is comprised of two pieces of crescent shaped vinyl measuring 17 cm from top to bottom and 31 cm across the widest part. The detachable, inflatable safety bar 18 can be seen in FIG. 1 placed across the top of the front of the primary inflatable piece 12. The safety bar 18 attaches to the primary inflatable piece 12 with snaps 26 to the outer sides of the primary piece 12. The safety bar 18 is comprised of two pieces of vinyl measuring 87 cm in length and 8.5 cm in width. The ends of the safety bar 18 are non-inflatable and have two snaps 26 attached, leaving the inflatable section of the safety bar to have a length of 67 cm.

In FIG. 2, the back view, the placement of the elongated, rectangular piece 30 is shown attached to the primary inflatable piece 12. Along the top of this view the top of the back of the head and neck support piece 16 can be seen with the air valve 28 strategically placed where an infant cannot reach it when seated in the device 10.

Figure 3:
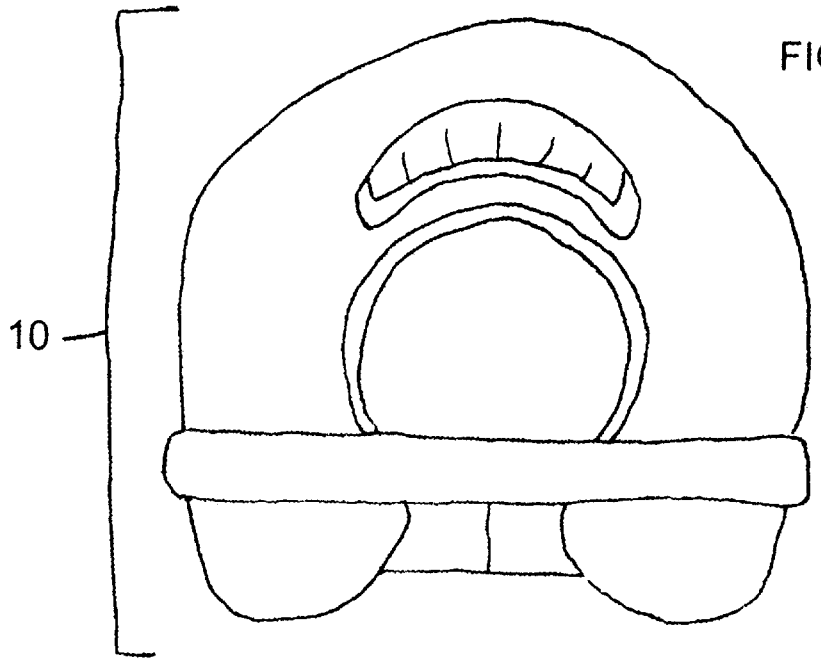
FIG. 3 is a top plan View of the sifting support disclosed in the present invention.
Figure 4:
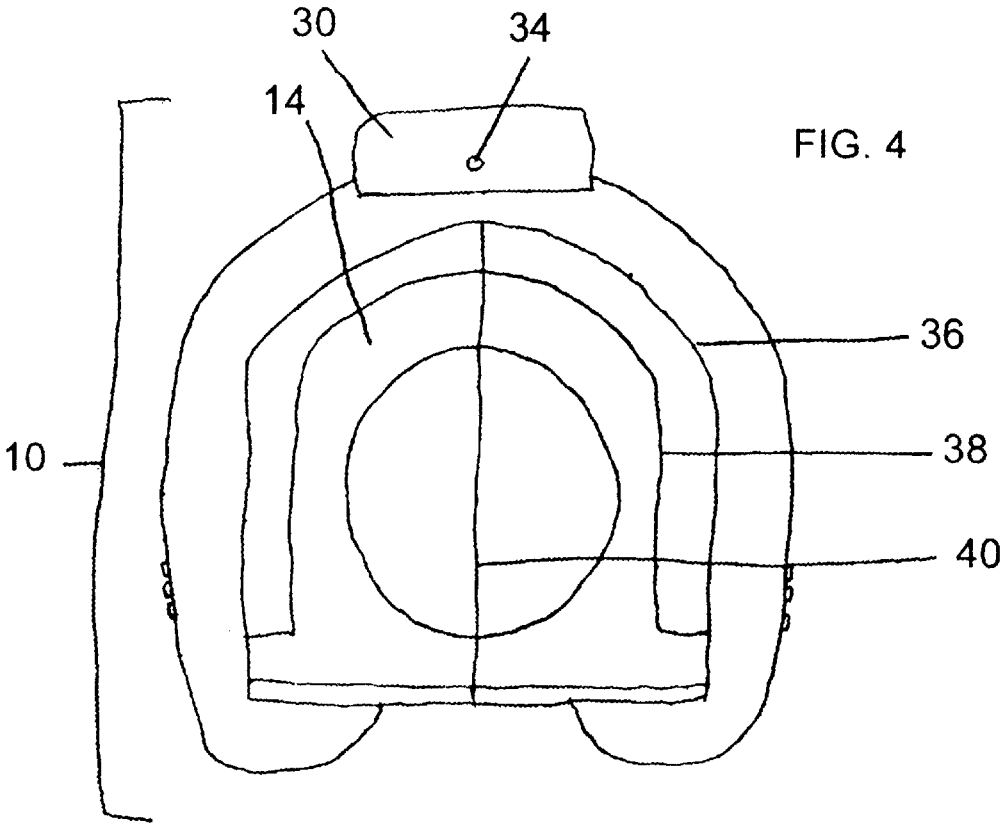
FIG. 4 is a bottom plan view of the sitting support disclosed in the present invention.

FIG. 3 shows the sitting support device 10 from the top with the safety bar attached. FIG. 4 shows the bottom of the sitting support device 10 and allows the viewer to see the placement of the air valve 34 in the elongated, rectangular piece 30. This view also shows the placement of the seams 36 and 38 where the non-inflatable seat base 14 is attached to the primary piece 12. The outer seam 36 is located along the midpoint of the sides of the "U" or horseshoe shaped piece 12 and the inner seam 38 is located approximately 4 cm more towards the center of the primary piece 12. The seam down the middle 40 of the seat base 14 shows where the vinyl to make the seat base 14 has had a triangular piece cut out and has been sealed back together again in order to make the seat base 14 slightly concave for greater stability when an infant is sitting in the device 10.

Figure 5:
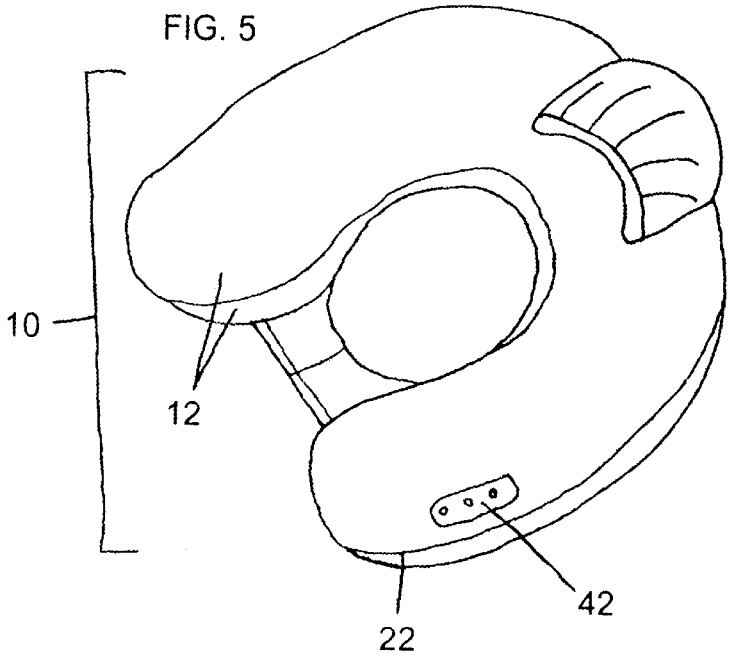
FIG. 5 is a perspective view of the sitting support disclosed in the present invention without the inflatable support bar attached.

FIG. 5 shows the sitting support device 10 with the safety bar 18 detached. In this view the piece of vinyl with the snap attachments 42 can be seen. The bottom of the snap attachment piece of vinyl 42 is located approximately 1 cm above the seam 22 running along the outer sides of the primary piece 12. The three snap attachments on the vinyl 42 allow for the inflatable safety bar 18 to be snapped across the front of the top of the primary piece 12 in two positions, one for a smaller infant and one for a larger infant or child.

Figure 6:
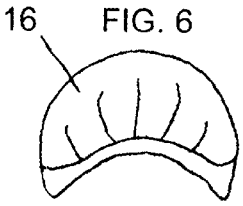
FIG. 6 is a detail view of the attached head and neck support for the sitting support disclosed in the present invention.
Figure 7:
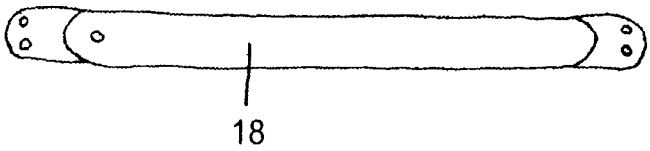
FIG. 7 is a detail bottom view of the detachable, inflatable safety bar disclosed in the present invention.
Figure 8:
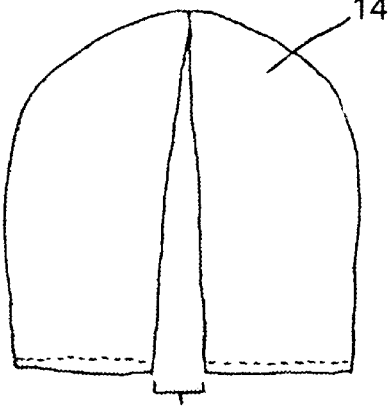
FIG. 8 is a detail view of the piece of vinyl used to make the non-inflatable base have a concave shape.
Figure 9:
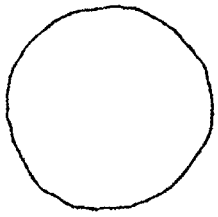
FIG. 9 is a detail view of the piece of rayon-flocked vinyl used to cover the cushioned section of the non-inflatable base.
Figure 10:
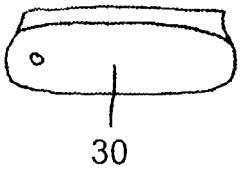
FIG. 10 is a detail view of the elongated, rectangular piece sealed to the bottom of the back of the sitting support disclosed in the present invention.

FIG. 6 is a view of the front of the head and neck support 16 and is used to show the approximate shape of the piece 16 when viewing it from the front. FIG. 7 is a view of the underside of the inflatable safety bar 18 and shows the placement of the air valve. FIG. 8 shows a piece of vinyl with a triangular section cut out of it 46 that is used to make the non-inflatable seat base 14 have a concave shape, thereby lending more stability to the device 10 when in use. FIG. 9 shows the piece of rayon-flocked vinyl used to cover the cushioned section 20 of the seat base 14. Finally, FIG. 10 shows the general shape of the elongated, rectangular piece 30 that is attached to the bottom of the back of the primary piece 12 to provide added stability.

What I claim as my invention is:

1. An inflatable infant sitting support device comprising:

a primary inflatable piece being "U" or horseshoe shaped, including a curved section forming the back of the inflatable infant sitting support with two spaced-apart straight sections at the opposite ends of the curved section and extending forwardly to the front two straight sections of the primary inflatable piece of the inflatable infant sitting support;

a flat, non-inflatable, cushioned base shaped to efficiently enclose the central opening and form the bottom of the primary inflatable piece, with the top of the inflatable infant sitting support having an open side to receive the infant;

an inflatable, crescent-shaped head and neck support sealed to the top of the curved section at the back of the primary inflatable piece;

an elongated, rectangular, supportive inflatable piece sealed to the bottom of the back of the curved section of the primary inflatable piece;

a detachable, inflatable safety bar sufficient in length to completely extend across the width of the top of the open side of the primary inflatable piece when attached to both outer sides of the primary inflatable piece.

2. A device according to claim 1 wherein all of the primary inflatable piece, the cushioned base, the head and neck support, the supportive inflatable piece and the inflatable safety bar are constructed of any soft, plastic sheet material.

3. A device according to claim 1 wherein the non-inflatable base has a cushioned portion filled with a soft material.

4. A device according to claim 3 wherein the cushioned portion is covered with a non-skid, non-stick surface.

5. A device according to claim 1 wherein the non-inflatable base is sealed to the bottom of the primary inflatable piece along one or more lines following the "U" or horseshoe shape of the primary inflatable piece.

6. A device according to claim 1 wherein there is a hook and loop fastener attached to the bottom of the device.

7. A device according to claim 1 wherein the non-inflatable base can be made to have a slightly concave shape.

8. A device according to claim 1 wherein the non-inflatable base is a flat piece of soft plastic material.

* * * * *